US006957471B2

(12) United States Patent
Zhao

(10) Patent No.: US 6,957,471 B2
(45) Date of Patent: Oct. 25, 2005

(54) CLEANING RINGS FOR INSULATOR DRIVEN BY WIND

(76) Inventor: Shuhai Zhao, 173 Fenhuang S. Road, Yanhu District, Yuncheng, Shanxi 044000 (CN)

( * ) Notice: Subject to any disclaimer, the term of this patent is extended or adjusted under 35 U.S.C. 154(b) by 0 days.

(21) Appl. No.: 10/482,514

(22) PCT Filed: Jun. 5, 2002

(86) PCT No.: PCT/CN02/00393

§ 371 (c)(1),
(2), (4) Date: Dec. 30, 2003

(87) PCT Pub. No.: WO03/005391

PCT Pub. Date: Jan. 16, 2003

(65) Prior Publication Data

US 2004/0168277 A1 Sep. 2, 2004

(30) Foreign Application Priority Data

Jul. 3, 2001 (CN) ..... 01228431 U

(51) Int. Cl.[7] ..... B08B 3/02; H01B 17/75

(52) U.S. Cl. ..... 15/256.6; 15/246; 174/211; 174/139

(58) Field of Search ..... 15/246, 256.6; 174/172, 174, 211, 139; 446/418, 421; 63/3–4, 21, 23, 37–39

(56) References Cited

U.S. PATENT DOCUMENTS 178,352 A * 6/1876 Wheeler ..... 446/247
2,130,427 A * 9/1938 Hoover ..... 446/418
2,263,340 A * 11/1941 Kraemer ..... 59/80
3,597,789 A * 8/1971 Boyd ..... 15/383
4,388,487 A * 6/1983 Petrossian-Avakian .... 170/40 R
5,119,851 A * 6/1992 Paris ..... 134/172
D403,072 S * 12/1998 Rogers Huante ..... D24/194
6,349,568 B1 * 2/2002 Ito ..... 63/3

FOREIGN PATENT DOCUMENTS

| | | |
|---|---|---|
| CN | U-87204058 | 3/1988 |
| CN | Y-2158306 | 9/1994 |
| CN | Y-2368137 | 3/2000 |
| DE | 3209412 | 9/1983 |
| JP | 8185743 | 7/1996 |
| JP | 11232945 | 8/1999 |

* cited by examiner

*Primary Examiner*—John Kim
*Assistant Examiner*—Shay Balsis
(74) *Attorney, Agent, or Firm*—Gardere Wynne Sewell LLP

(57) ABSTRACT

A wind driven cleaning ring apparatus for removing dirt on electrical insulators used in electric systems. The cleaning ring apparatus includes spaced apart bowl members supported on a cylindrical ring member by being sleeved over the ring member or formed integral therewith. The bowl members may be hemispherical or conical in shape and may be held spaced apart on the ring member by spherical or cylindrical beads. The bowl members may include a peripheral scraper edge. Spaced apart circular brushes and/or scraper members may be mounted on the ring member between respective ones of the bowl members.

20 Claims, 12 Drawing Sheets

CLEANING RINGS FOR INSULATOR DRIVEN BY WIND

BACKGROUND OF THE INVENTION

At present, the surfaces of electrical insulators used in electric systems may become seriously begrimed. Accordingly, after a period of time such insulators must be cleaned. Conventional methods used to clean electrical insulators are by manual cleaning, or by machines or by rinsing with electrified (ionized) water. However, cleaning by manual effort and by machine takes unnecessary time and requires substantial efforts. Rinsing electrical insulators by electrified water is typically too expensive. Moreover, cleaning by manual effort or by machine is not possible in some application or locations of insulators because of geographic barriers or other factors which affect access to the insulators. Removal of dirt on insulators should be done promptly, regardless of the method employed, to avoid the generation of sparking or arcing which can frequently happen in electric systems with dirty insulators.

Accordingly, there has been a need to provide improved methods and apparatus for cleaning insulators of electric systems.

SUMMARY OF THE INVENTION

In accordance with the invention, electric system insulators may be provided with cleaning ring apparatus driven by wind to clean dirt from such insulators. The cleaning ring apparatus may comprise a ring formed of insulative material and carrying spaced apart orbicular or circular brushes or scraper devices and the like. The brush or scraper devices are driven by the wind in outdoor applications to drive an associated ring arrangement in a turning mode which will scrape dirt and debris off of the surface of the insulator. Therefore, insulators of electric systems may be kept clean at all times and sparks caused by dirty insulators are prevented.

In accordance with another aspect of the invention, an insulator cleaning apparatus includes a ring provided with bowl-like scraping members sleeved thereon and arranged in the same orientation to be driven by the wind, and whereby peripheral edges of the bowl members operate to ceaselessly scrape dirt off of the surfaces of an insulator to maintain the insulator clean and prevent electrical arcing or sparking caused by dirt on the insulator.

The invention provides several advantages, including continuous removal of dirt from an insulator so that the surface of the insulator is not constantly or forever begrimed. The cleaning ring apparatus of the present invention also saves substantial expenditure of manpower and material resources and avoids the hazards associated with other insulator cleaning methods.

Those skilled in the art will further appreciate the above-mentioned advantages and superior features of the invention upon reading the detailed description which follows in conjunction with the drawing.

DETAILED DESCRIPTION OF THE PREFERRED EMBODIMENTS

Figure 1A:
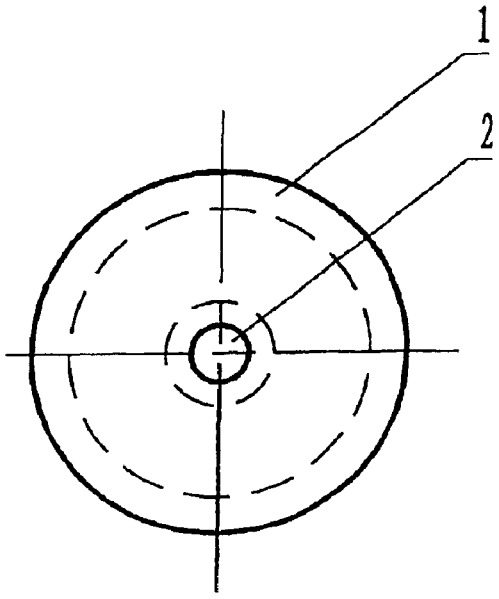
FIGS. 1A and 1B are front elevation and longitudinal central section views, respectively, of a wind driven hemispheroidal bowl-shaped member in accordance with the present invention.
Figure 1B:
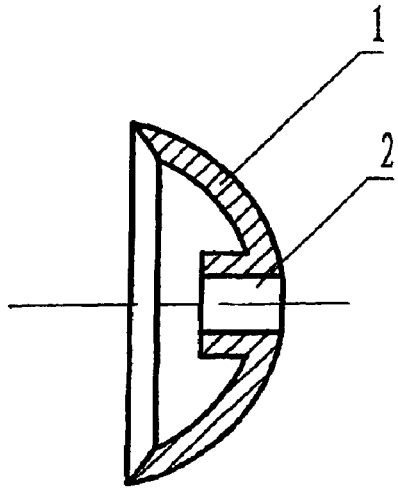
Figure 2A:
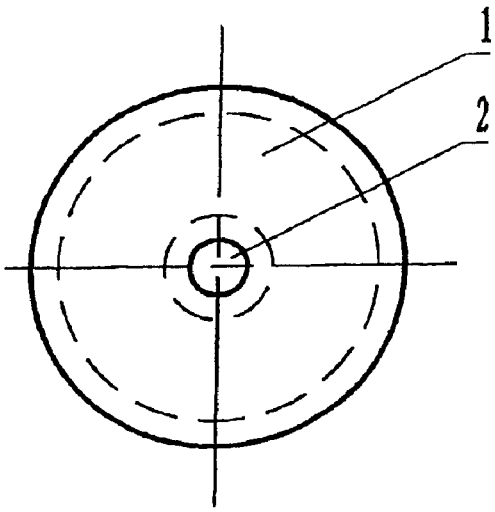
FIGS. 2A and 2B are front elevation and longitudinal central section views, respectively, of a conical shaped bowl member in accordance with the present invention.
Figure 2B:
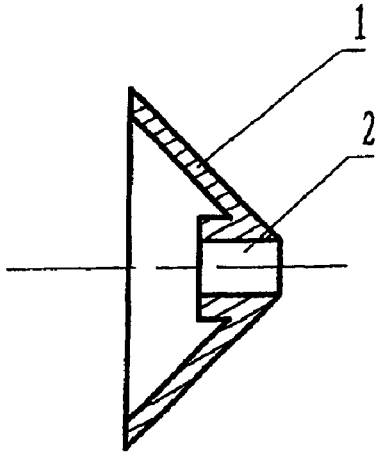
Figure 3A:
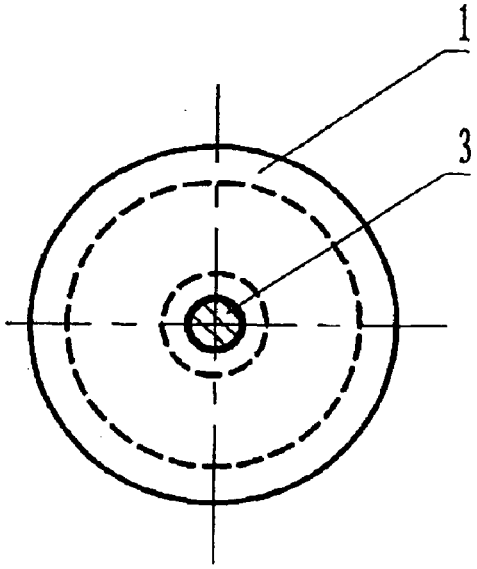
FIGS. 3A and 3B are front elevation and longitudinal central section views, respectively, of a hemispheroidal bowl shaped member, as shown in FIGS. 1A and 1B, sleeved over a ring member.
Figure 3B:
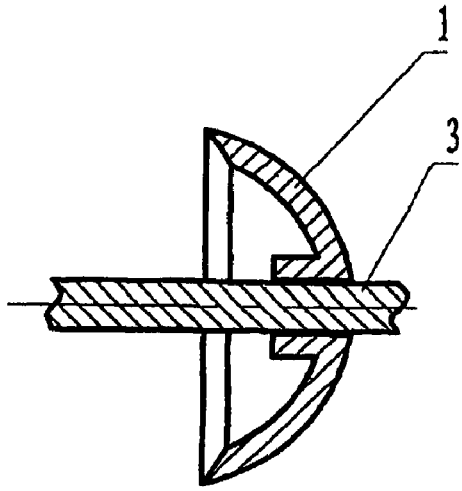
Figure 4A:
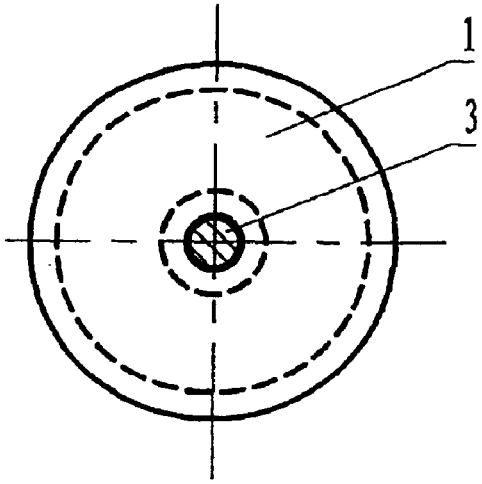
FIGS. 4A and 4B are front elevation and longitudinal central section views, respectively, of a conical bowl shaped member as shown in FIGS. 2A and 2B, sleeved over a ring member.
Figure 4B:
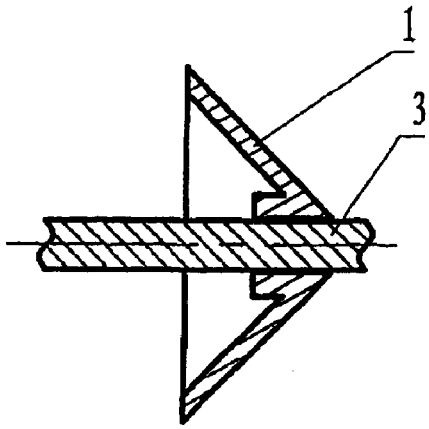
Figure 5:
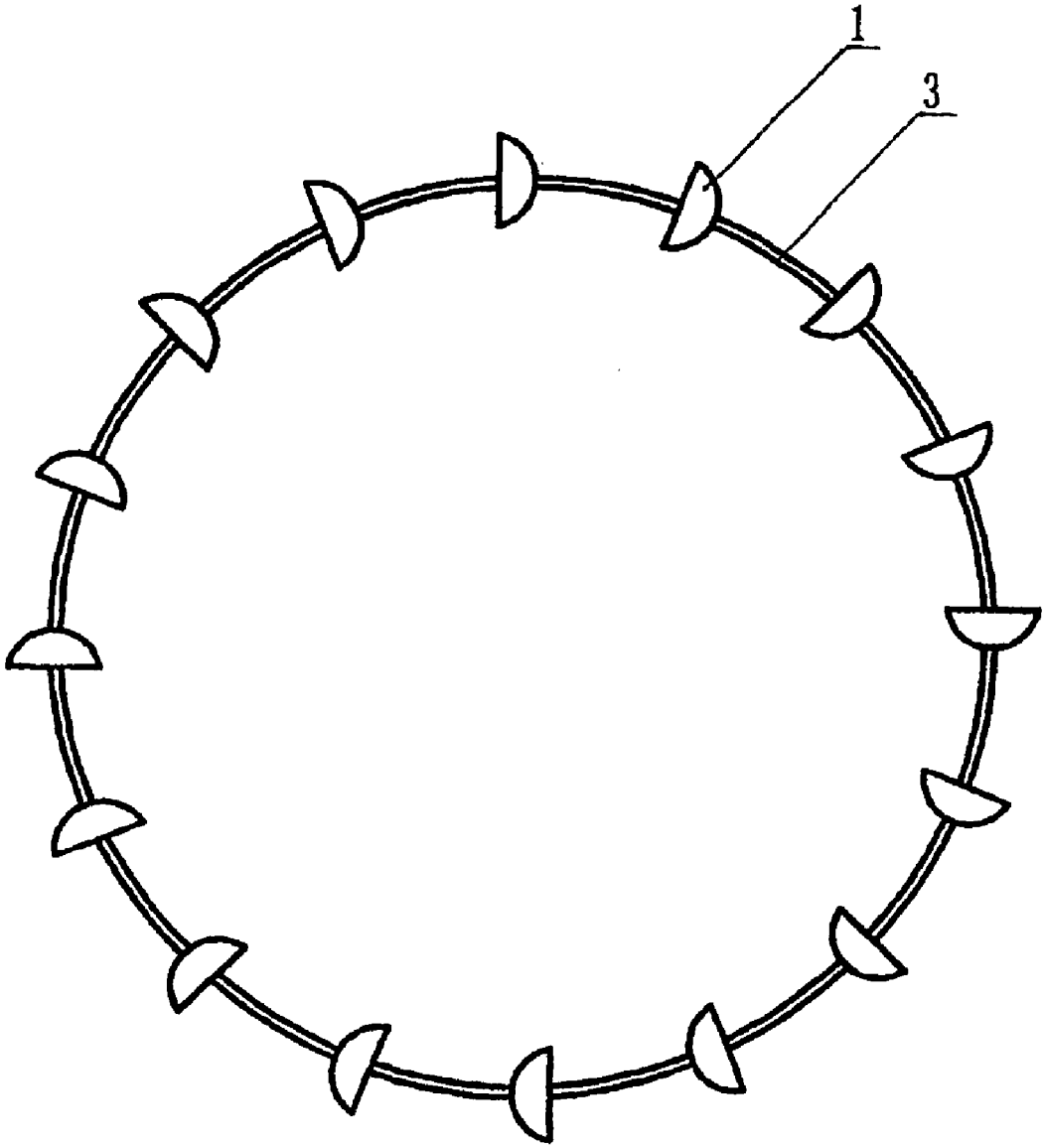
FIG. 5 is a plan view of a cleaning ring apparatus in accordance with the invention.
Figure 6:
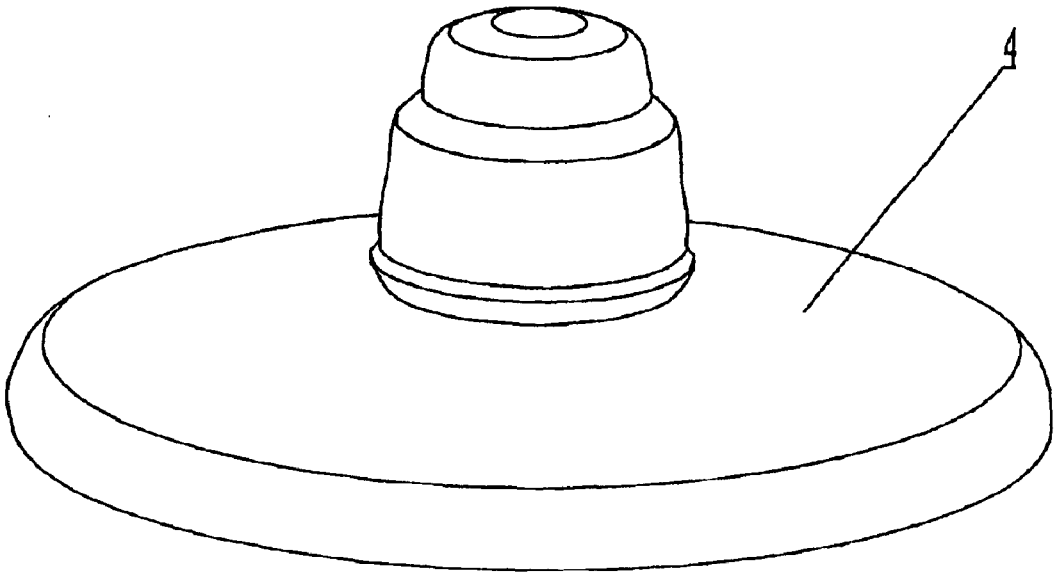
FIG. 6 is a perspective view of an insulator of a type to be cleaned by the apparatus of the present invention.

FIGS. 1A through 7 illustrate one preferred embodiment of the invention wherein hemispheroidal, parabolic, conical or other tapered bowl members 1 are provided with a central eyelet or bore 2 and may be mounted on a cylindrical and circular ring 3, as shown in FIGS. 3A through 4B, as well as FIG. 5. The bowl members 1 may be secured to the ring 3 spaced apart by an adhesive and are arranged to face in the same direction, as illustrated. The ring apparatus comprising bowl members 1 of the configuration shown in either FIGS. 1A and 1B or 2A and 2B are secured spaced apart on ring 3 which may be mounted on an insulator 4 of the type shown in FIG. 6.

Figure 7:
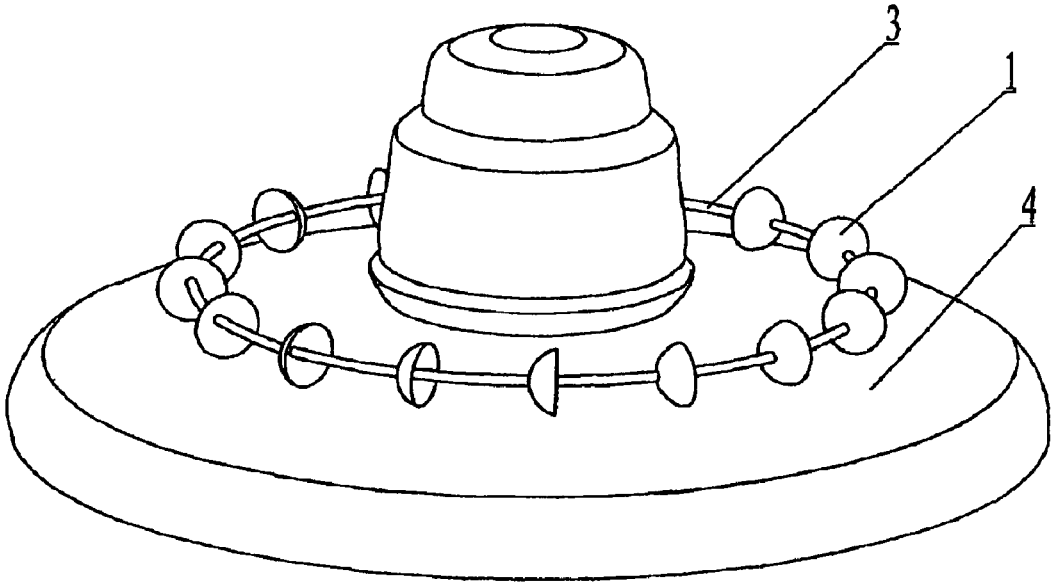
FIG. 7 is a perspective view of the insulator shown in FIG. 6 with a wind-driven cleaning ring apparatus in accordance with the invention disposed thereon.
Figure 8A:
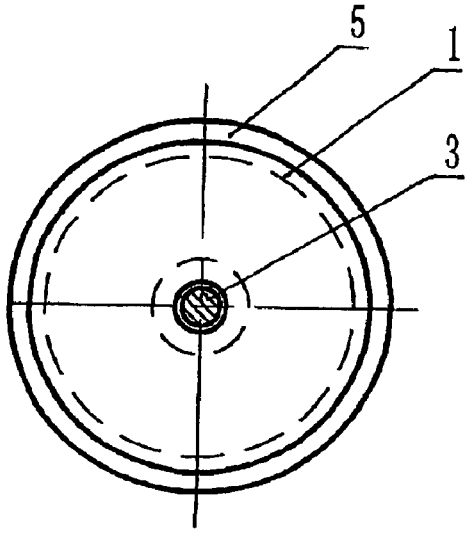
FIGS. 8A and 8B are front elevation and longitudinal central section views, respectively, of a modified hemispheroidal bowl member in accordance with the invention including a peripheral scraping edge formed thereon and shown mounted on a cleaning ring.
Figure 8B:
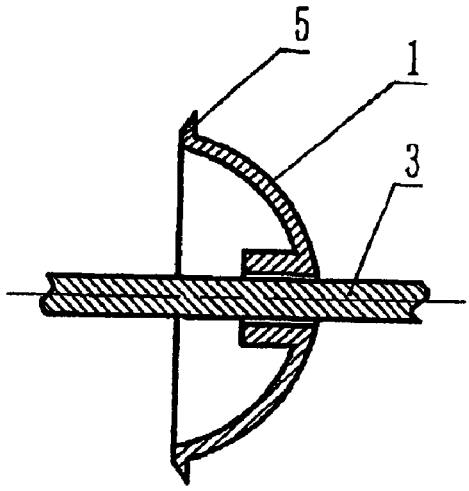
Figure 9A:
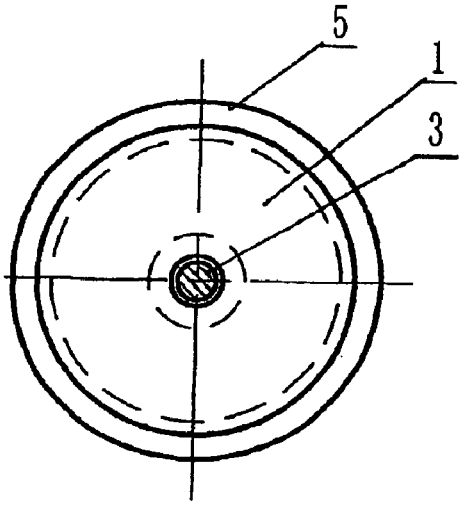
FIGS. 9A and 9B are front elevation and longitudinal central section views, respectively, of a conical bowl member including a peripheral scraper edge formed thereon and shown mounted on a cleaning ring.
Figure 9B:
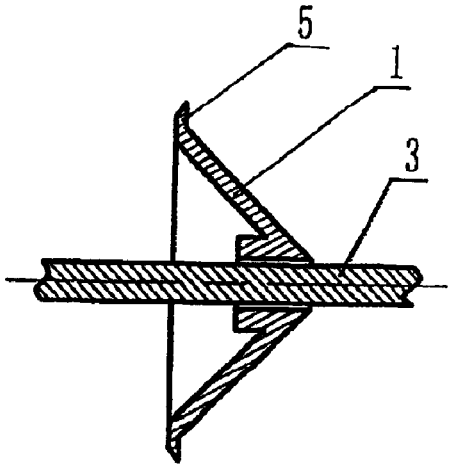

FIG. 7 shows the cleaning ring apparatus of the embodiment of FIGS. 1A through 7 mounted on the insulator whereby the ring assembly may be constantly driven by available wind to scrape dirt off the surface of the insulator and keep it sufficiently clean to prevent electrical sparking. The cleaning ring apparatus shown in FIG. 7 may be formed from electrical insulating type materials such as plastic, rubber, nylon and similar electrical insulating materials. The cleaning ring apparatus shown in FIG. 7 can be secured on a porcelain insulator 4 or similar insulator used in electrical systems.

As shown in FIGS. 8A through 9B, hemispheroidal shaped bowl members or conical shaped bowl members 1 may be modified to include a peripheral edge 5 which facilitates scraping dirt off of an insulator, such as the insulator 4, if these bowl members are substituted for the bowl members 1 of the type shown in FIGS. 1A through 2B. The peripheral edges 5 formed on the hemispheroidal or conical shaped bowl members are indicated to be favorable for removing dirt from an insulator.

Figure 10:
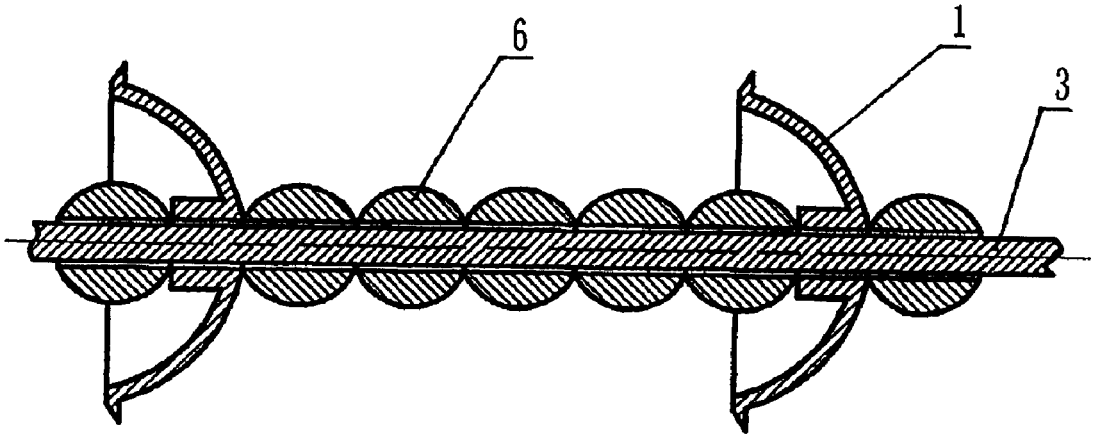
FIG. 10 is a longitudinal central section view of a portion of a wind-driven cleaning ring apparatus showing spherical spacer beads disposed between the bowl members.
Figure 11:
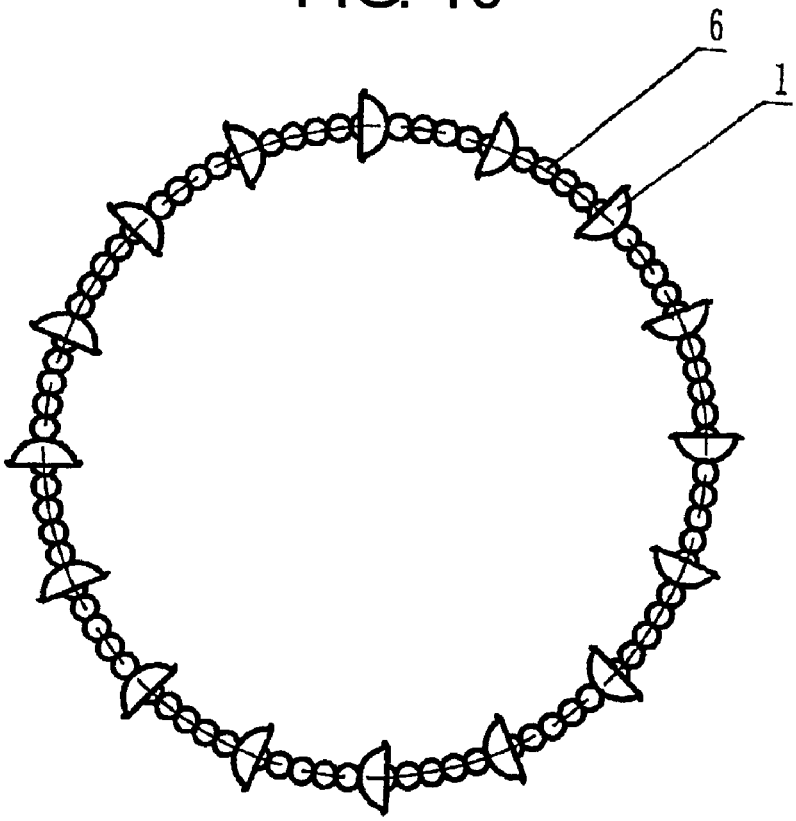
FIG. 11 is a plan view of a cleaning ring apparatus of the type shown in FIG. 10.
Figure 12:
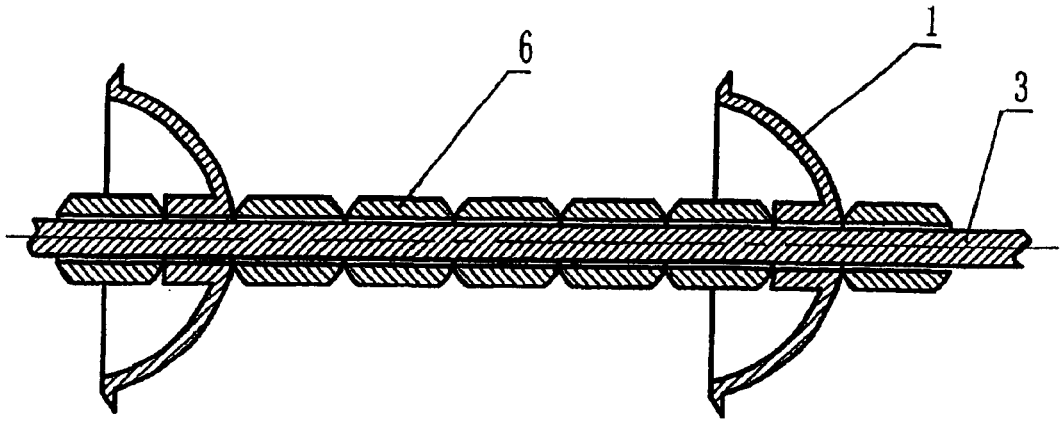
FIG. 12 is a longitudinal central section view of a portion of a cleaning ring with elongated spacers disposed for spacing hemispheroidal bowl members, as shown.

Referring to FIGS. 10, 11 and 12, another embodiment of the invention is illustrated wherein hemispheroidal bowl members 1 may be mounted on a ring 3 spaced apart by spherical beads 6 each having a central bore or eyelet. The beads 6 are provided to fix the distance between the bowl members 1. FIG. 11 illustrates a cleaning ring apparatus using spherical spacer beads 6 and hemispheroidal shaped bowl members 1 arranged to face in the same direction and held spaced apart by the beads 6. As shown in FIG. 12, the beads 6 may also assume a cylindrical or cannular shape for maintaining the bowl members 1 spaced apart.

Figure 13:
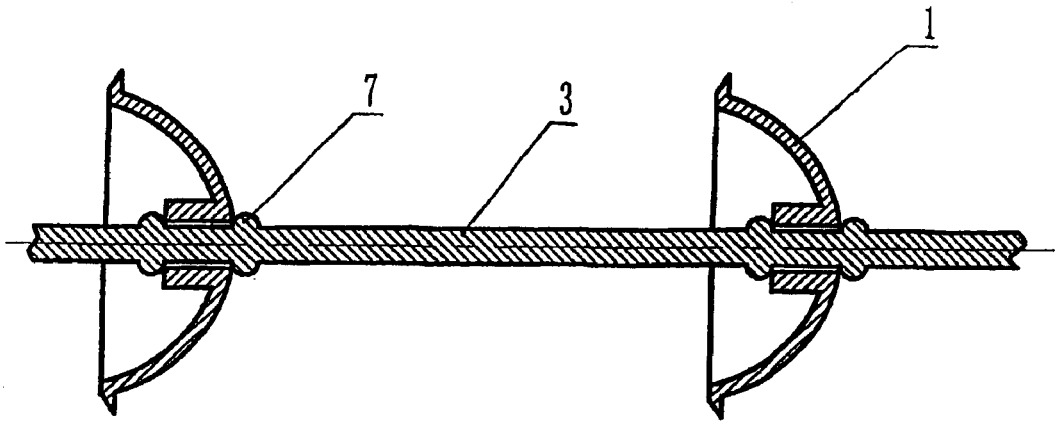
FIG. 13 is a longitudinal central section view of a portion of a cleaning ring apparatus showing hemispheroidal bowl members with peripheral scraper edges and supported on a ring member by protuberances formed on the ring member.

Another embodiment of the invention is illustrated in FIG. 13, wherein bowl members 1 are mounted on a modified ring 3 which includes circumferential ring-like protuberances 7 formed thereon to secure the bowl members spaced apart, as shown.

Figure 14:
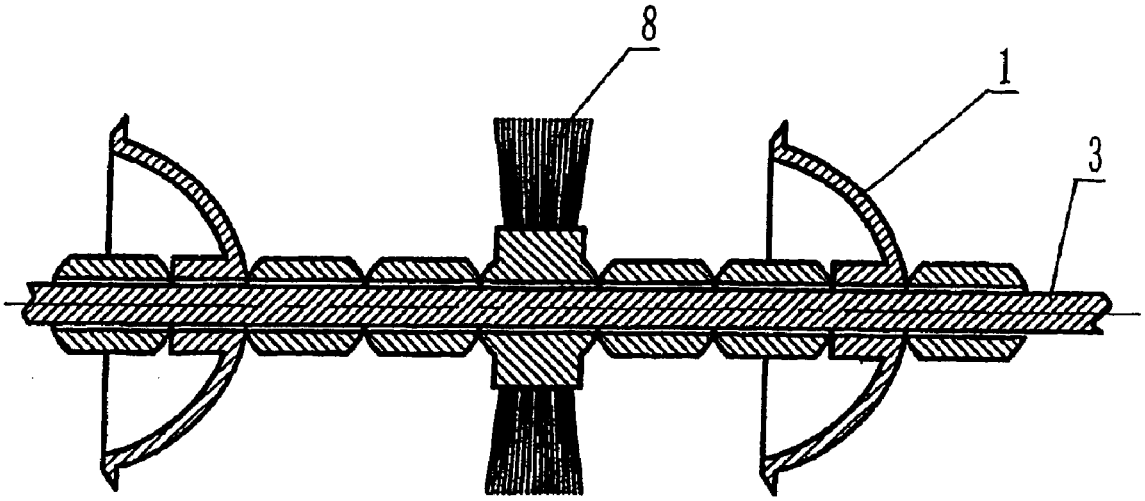
FIG. 14 is a longitudinal central section view of a part of a cleaning ring apparatus including spaced apart hemispheroidal bowl members with a circular brush member disposed therebetween and spaced apart by elongated spacers.
Figure 15A:
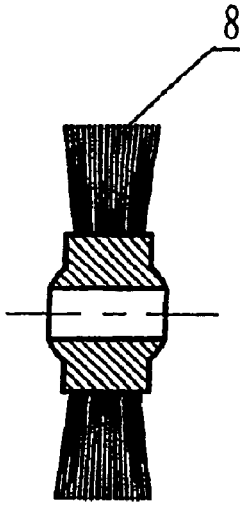
FIGS. 15A and 15B are longitudinal central section and front elevation views, respectively, of a cleaning brush of the type shown in FIG. 14.
Figure 15B:
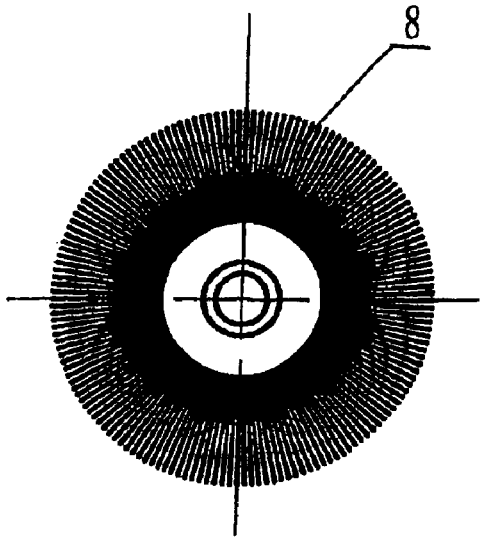

Referring to FIGS. 14, 15A and 15B, a cylindrical or circular brush 8 may be mounted between bowl members 1 and supported on the ring 3. The brushes 8 are provided with eyelets or bores so that they may be sleeved over the ring 3 spaced apart between the bowl members 1 as shown. The brushes 8 improve the speed with which an insulator may be cleaned by a cleaning ring apparatus in accordance with the invention.

Figure 16:
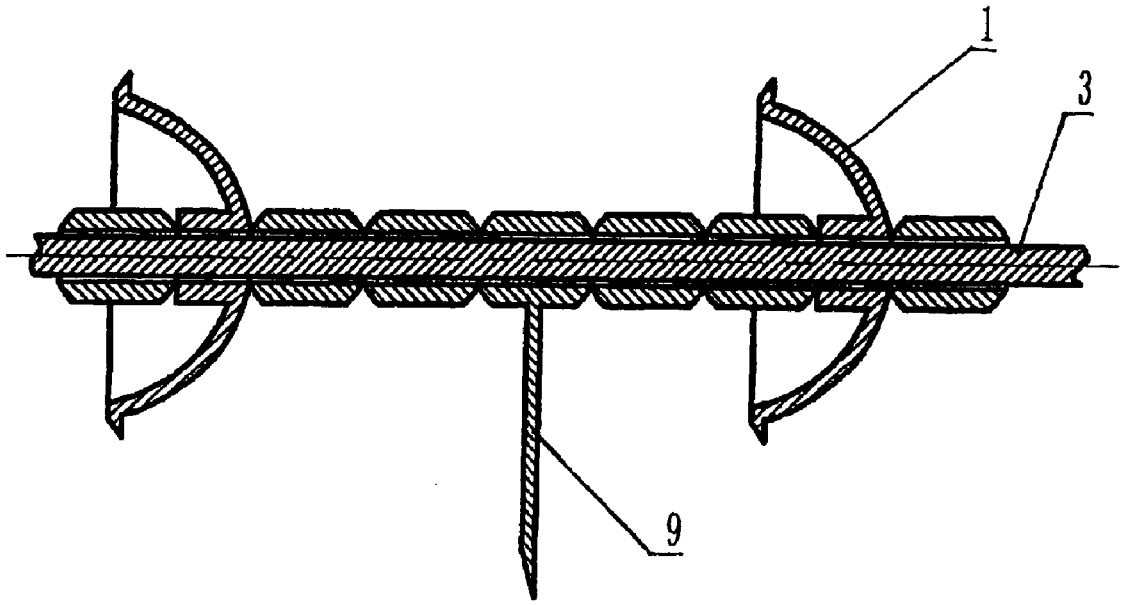
FIG. 16 is a longitudinal central section view of part of a cleaning ring apparatus showing spaced apart hemispheroidal bowl members with peripheral scraper edges and a separate scraper member disposed therebetween.
Figure 17A:
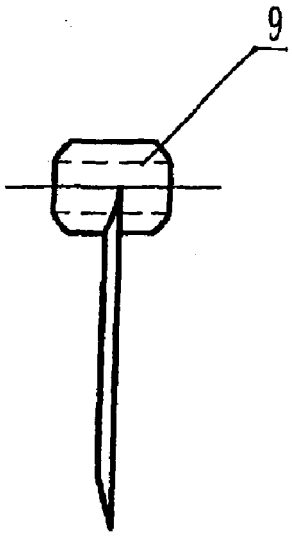
FIGS. 17A and 17B comprise a side elevation and an end view, respectively, of a scraper member of the type shown in FIG. 16.
Figure 17B:
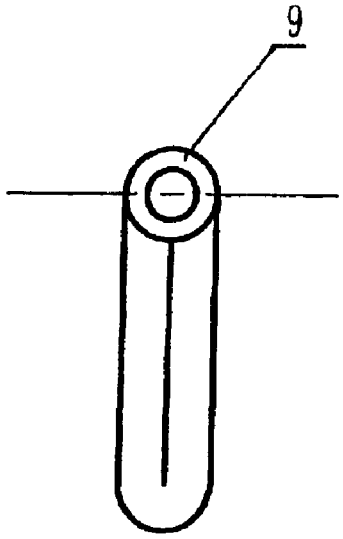
Figure 18A:
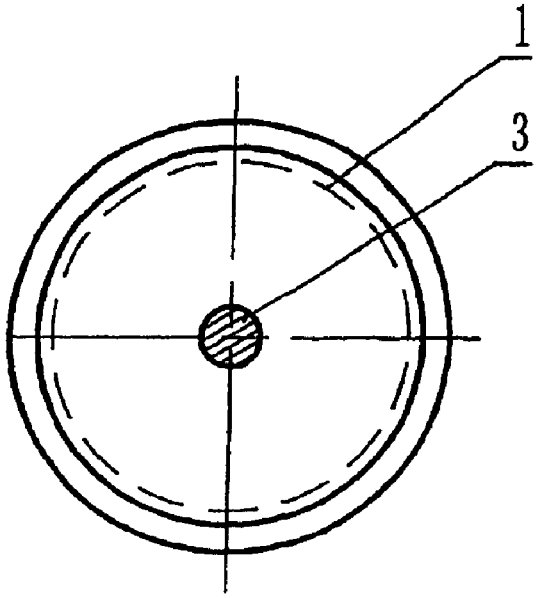
FIGS. 18A and 18B are front elevation and longitudinal central section views, respectively, of part of a cleaning ring apparatus with a hemispheroidal bowl member integrated with the ring member.
Figure 18B:
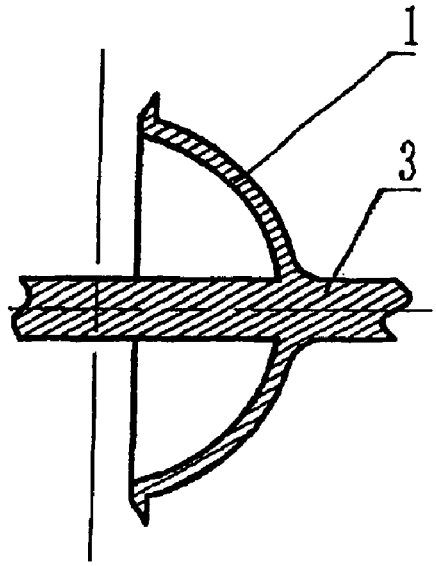
Figure 19A:
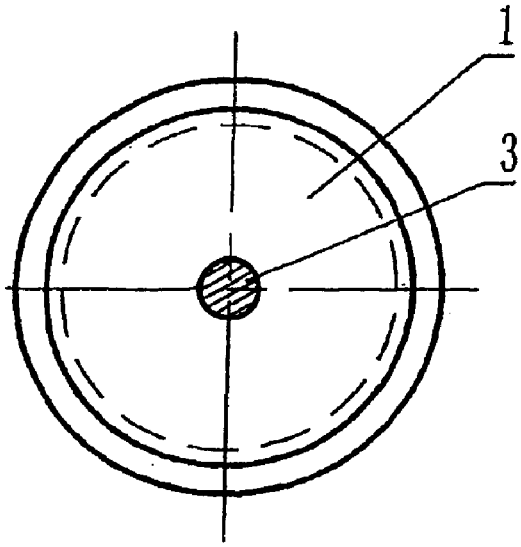
FIGS. 19A and 19B are front elevation and longitudinal central section views, respectively, of a cleaning ring apparatus with a conical bowl member integrated with the ring member.
Figure 19B:
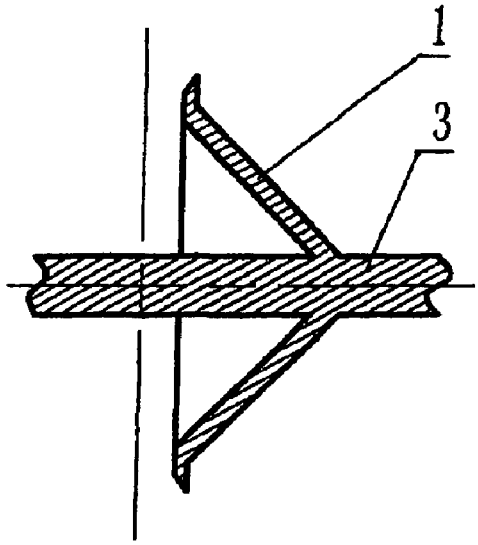

Referring to FIGS. 16, 17A and 17B, another preferred embodiment of the invention is illustrated wherein hemispheroidal bowl members 1 are supported spaced apart on the cleaning ring 3 and a scraper member 9 is supported between the bowl members.

Referring to FIGS. 18A through 19B, another embodiment of the invention is illustrated wherein the bowl members 1 are formed integral with a ring 3.

Figure 20:
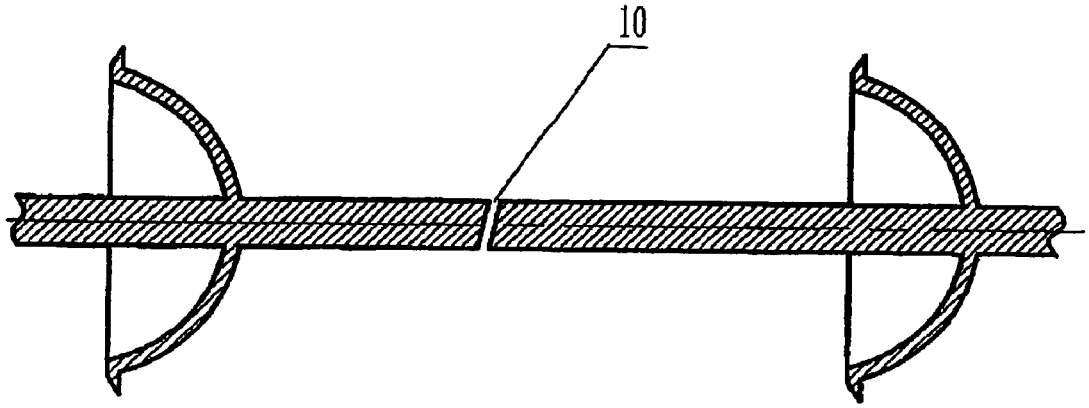
FIG. 20 is a longitudinal central section view of a part of a cleaning ring apparatus in accordance with the invention with a ring member which is split.
Figure 21:
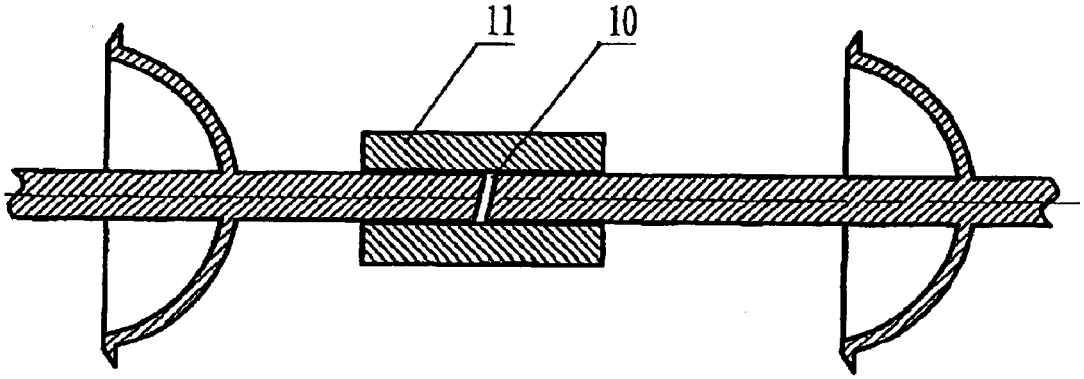
FIG. 21 is a view similar to FIG. 20, showing a connector for connecting the ends of a split ring together.

Still further, referring to FIGS. 20 and 21, another embodiment of the invention is illustrated wherein the bowl members are formed integral with the ring and the ring is provided with a joint 10 which is secured by a connector 11 which may be bonded or welded to the cleaning ring to form it as a circular ring assembly.

Figure 22:
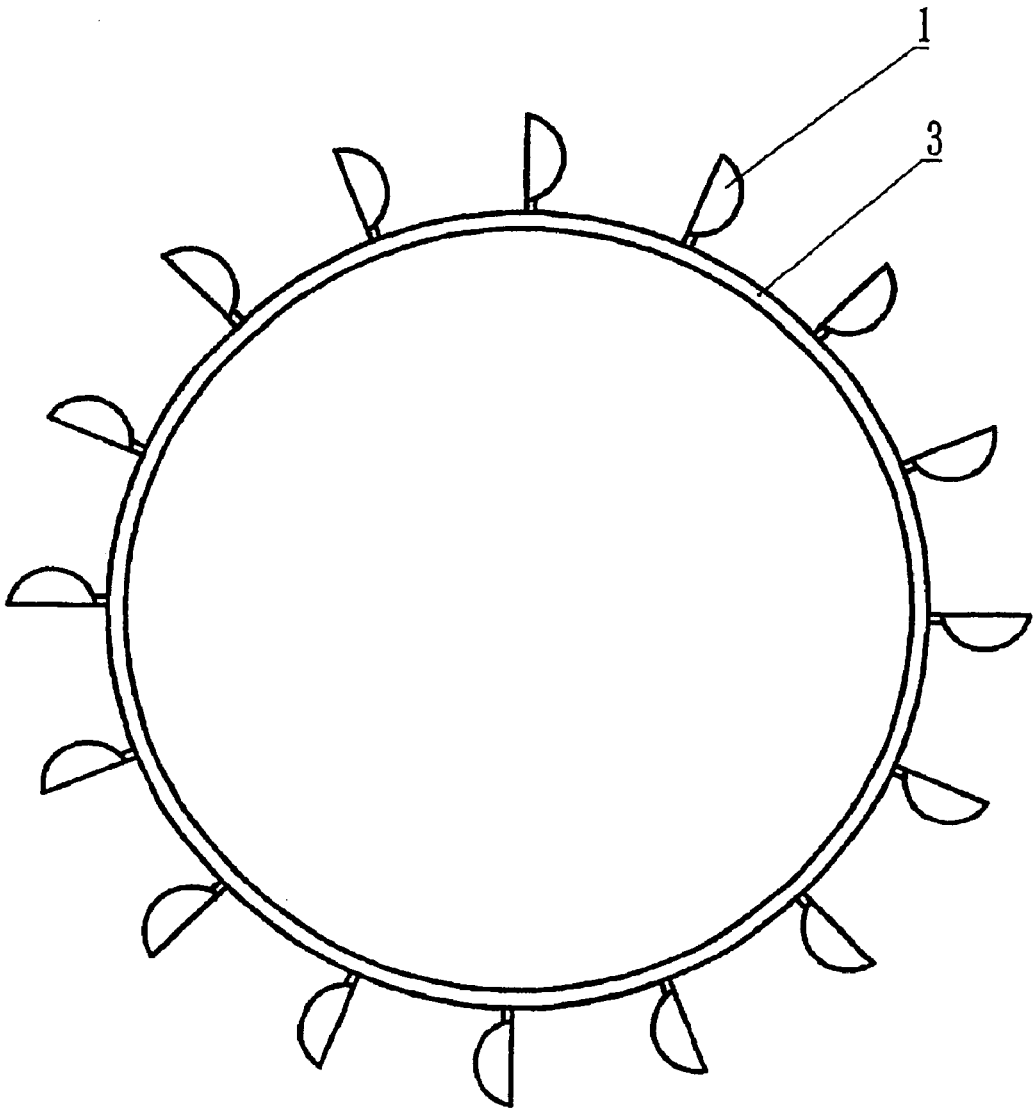
FIG. 22 is a plan view of a wind driven insulator cleaning ring apparatus with bowl members mounted radially outwardly of the ring member.

Referring still further to FIG. 22, another embodiment of the invention is illustrated, which is different from the cleaning ring assemblies described above, wherein the bowl members 1 are not sleeved or threaded centrally on the ring 3 but are fixed to the ring radially outwardly on one side thereof, as illustrated.

Although preferred embodiments of the invention have been described and illustrated herein, those skilled in the art will recognize that various substitutions and modifications may be made to the invention without departing from the scope and spirit of the appended claims.

What is claimed is:

1. An electrical insulator having a generally upwardly facing surface, in combination with a wind driven cleaning ring apparatus disposed on said surface of said insulator and for cleaning said surface of said insulator comprising a plurality of members supported on a ring and secured to said ring spaced apart from each other and engaged with said surface of said insulator for cleaning dirt from said surface of said insulator by scraping said surface of said insulator in response to wind driving said members to rotate said apparatus with respect to said insulator.

2. The invention set forth in claim 1 wherein:

said members have peripheral edges engageable with said surface of said insulator for scraping dirt therefrom.

3. The invention set forth in claim 1 including:

spacers sleeved over said ring between adjacent ones of said members for securing said members spaced apart on said ring.

4. The invention set forth in claim 1 wherein:

said members are held spaced apart on said ring by spaced apart protuberances formed on said ring.

5. The invention set forth in claim 1, including:

spaced apart circular brushes supported on said ring between adjacent ones of said members.

6. The invention set forth in claim 1, including:

elongated scrapers supported on said ring between adjacent ones of said members.

7. The invention set forth in claim 1 wherein:

said members are formed integral with said ring.

8. The invention set forth in claim 1 wherein:

said members have central eyelets or bores for sleeving said members over said ring.

9. The invention set forth in claim 1 wherein:

said members comprise generally hemispheroidal shaped bowl members oriented in the same direction on said ring.

10. The invention set forth in claim 1 wherein:

said members comprise generally conical shaped bowl members oriented in the same direction on said ring.

11. The invention set forth in claim 1 wherein:

said ring is formed of an electrically insulative material.

12. The invention set forth in claim 1 wherein:

said members are formed of an electrically insulative material.

13. The invention set forth in claim 1 wherein:

said members are supported projecting radially outwardly of said ring.

14. The invention set forth in claim 1 wherein:

said ring is split and includes a connector for joining opposite ends of said ring.

15. An electrical insulator having a generally upwardly facing surface, in combination with a wind driven cleaning ring apparatus disposed on said surface of said insulator for cleaning said surface of said insulator comprising a generally cylindrical ring member and a plurality of bowl shaped members supported on said ring member and retained spaced apart from each other and engaged with said surface of said insulator for cleaning dirt from said surface of said insulator by scraping said surface of said insulator in response to wind driving said bowl members to rotate said apparatus with respect to said insulator.

16. The invention set forth in claim 15 wherein:

said bowl members are hemispheroidal shaped and have a peripheral edge engageable with said surface of said insulator.

17. The invention set forth in claim 15 wherein:

said bowl members are conical shaped and have a peripheral edge engaged with said surface of said insulator.

18. The invention set forth in claim 15 including:

plural spacers sleeved over said ring member and operable to position said bowl members spaced apart on said ring member.

19. The apparatus set forth in claim 15 including:

scraper plate members spaced apart on said ring member between said bowl members for engagement with said surface of said insulator for scraping same in response to rotation of said apparatus.

20. An electrical insulator having a generally upwardly facing surface, in combination with a wind driven cleaning ring apparatus for cleaning said surface of said insulator comprising a plurality of generally cylindrical brush members supported on and retained spaced apart on a ring and disposed on and engaged with said surface of said insulator for brushing dirt from said surface of said insulator in response to wind driving said ring apparatus to rotate with respect to said insulator.

* * * * *